US006523533B1

(12) United States Patent
Armstrong et al.

(10) Patent No.: US 6,523,533 B1
(45) Date of Patent: Feb. 25, 2003

(54) HIGH PRECISION BALL LAUNCH SYSTEM

(76) Inventors: Brian S. R. Armstrong, 4107 N. Prospect Ave., Shorewood, WI (US) 53211; Karl B. Schmidt, 2454 N. 96th St., Wauwatosa, WI (US) 53226

( * ) Notice: Subject to any disclaimer, the term of this patent is extended or adjusted under 35 U.S.C. 154(b) by 0 days.

(21) Appl. No.: 09/715,883

(22) Filed: Nov. 17, 2000

Related U.S. Application Data

(60) Provisional application No. 60/166,214, filed on Nov. 18, 1999.

(51) Int. Cl.[7] ..... F41B 3/00; A63B 69/40

(52) U.S. Cl. ..... 124/6; 473/451

(58) Field of Search ..... 124/6, 78; 473/451, 473/499

(56) References Cited

U.S. PATENT DOCUMENTS 1,223,386 A * 4/1917 Handelan
2,737,941 A * 3/1956 Carrau
4,471,746 A * 9/1984 Ando ..... 124/6
5,066,010 A * 11/1991 Pingston
5,292,119 A * 3/1994 Norcross

* cited by examiner

*Primary Examiner*—John A. Ricci
(74) *Attorney, Agent, or Firm*—Donald J. Ersler

(57) ABSTRACT

A high precision ball launch system includes a major link, minor link, drive device, ball release mechanism, and support base. The major link is pivotally attached to the support base and rotated about a major axis by the drive device. A minor axis of the minor link is pivotally attached to one end of the major link. The ball release mechanism is attached to one end of the minor link. The ball release mechanism is preferably positioned on the minor link such that a center of the ball passes through the major axis. The major link is rotated in one direction and the minor link is rotated in the opposite direction. A second embodiment of the high precision ball launch system includes a pair of linear translating drive surfaces, at least one drive device, and a carriage. Each linear translating drive surface includes a linear drive surface, a drive wheel, and an idler wheel. A first linear translating drive surface and a second linear translating drive surface are mounted to the carriage such that the ball may be propelled therethrough. One drive wheel must rotate in a clockwise rotation and the other drive wheel must rotate in a counter clockwise rotation. At least one drive device rotates both drive wheels.

19 Claims, 7 Drawing Sheets

HIGH PRECISION BALL LAUNCH SYSTEM

CROSS-REFERENCES TO RELATED APPLICATIONS

This is a utility application, taking priority from provisional patent application, Ser. No. 60/166,214 filed on Nov. 18, 1999.

BACKGROUND OF THE INVENTION

1. Field of the Invention

The present invention relates generally to ball pitching apparatuses and more specifically to a high precision ball launch system which launches a ball without error in trajectory.

2. Discussion of the Prior Art

It is desirable to throw a ball or other objection with great accuracy for training in baseball and other sports. Current technology uses rotating wheels, disks, or other means to accelerate the ball over a short distance and release the ball suddenly or while it is still under acceleration. The current technology of ball pitching apparatuses produces a ball release with jerk, vibration, and rapid change in acceleration, resulting in ball trajectory error.

Accordingly, there is a clearly felt need in the art for a high precision ball launch system which releases a ball without jerk, vibration, and rapid change in acceleration to produce a ball release without error in trajectory.

SUMMARY OF THE INVENTION

The present invention provides a high precision ball launch system which produces an accurate ball launch. The high precision ball launch system includes a major link, minor link, drive device, ball release mechanism, and support base. The major link is pivotally attached to the support base and rotated about a major axis by the drive device. The minor link is pivotally attached to one end of the major link and rotated about a minor axis. The ball release mechanism is attached to one end of the minor link. The ball release mechanism is preferably positioned on the minor link such that a center of the ball passes through the major axis. If the center of the ball passes through the major axis, the ball will have a straight line of trajectory and substantially zero acceleration when released. If the center of the ball does not pass through the major axis, the ball will not have substantially zero acceleration when released. The major link is rotated in one direction and the minor link is rotated in the opposite direction. However, the ball always moves in a straight line.

The rotation of the minor link may be provided through a chain or belt drive powered by the drive device. The drive device could be an electric motor, or any other suitable drive mechanism. The other end of the major link must be counter weighted to offset the weight of the minor link. The other end of the minor link must be counter weighted to offset the weight of the ball release mechanism. The ball release mechanism may retain the ball with a gripper mechanism, a vacuum device, or any other suitable mechanism.

Assuming counter clockwise rotation for the major link and clockwise rotation for the minor link with a top view; substantially zero velocity exists when the center of the ball, a major longitudinal axis of the major link, and minor longitudinal axis of the minor link are aligned on the axis of trajectory, and the ball at a right of the major axis. Assuming counter clockwise rotation for the major link and clockwise rotation for the minor link with a top view; substantially the highest velocity exists when the center of the ball is aligned above the major axis and the major longitudinal axis and the minor longitudinal axis are perpendicular to the axis of trajectory. The ball is preferably released when the high precision ball launch system achieves substantially the highest velocity and the ball is preferably grasped when the high precision ball launch system achieves substantially zero velocity. The acceleration is substantially zero at the instant of release, so the grasp force can be smoothly diminished and the release gentle. Spin could be imparted to the ball along an axis orthogonal to the line of release by providing a spinning ball release mechanism.

A second embodiment of the high precision ball launch system includes a pair of linear translating drive surfaces, at least one drive device, and carriage. Each linear translating drive surface includes a linear drive surface, a drive wheel, and an idler wheel. The linear drive surface could be a belt, sprocket driven chain, or any other suitable device. The drive wheel is disposed in one end of the linear drive surface and the idler wheel is disposed in the other end of the linear drive surface. A first linear translating drive surface and a second linear translating drive surface are mounted to the carriage such that the ball may be grabbed at an entrance and released at an exit. Preferably, a separate drive device is used for each linear translating drive.

When each drive wheel rotates, the linear drive surface translates. One drive wheel must rotate in a clockwise rotation and the other drive wheel must rotate in a counter clockwise rotation. The drive device could be an electric motor, or any other suitable drive mechanism.

Preferably, the distance of the linear drive surface is long enough to eliminate the effects of acceleration, jerk, and vibration. The distance between the linear drive surfaces at the exit is preferably slightly greater than at the entrance to provide a gentle release of the ball. A single guide plate may be attached behind each linear drive surface to provide the slightly greater distance at the exit than at the entrance. A set of wheels may also be used instead of the guide plate. A curvature could be imparted to the line of trajectory by translating each linear drive surface at a different speed. The carriage could also be rotated about the axis of trajectory to produce a ball pitch with spin.

Accordingly, it is an object of the present invention to provide a high precision ball launch system which releases a ball without error along the axis of trajectory.

It is a further object of the present invention to provide a high precision ball launch system which allows a ball to be spun about the axis of trajectory.

It is a further object of the present invention to provide a high precision ball launch system which allows a ball to be released with out vibration.

Finally, it is another object of the present invention to provide a high precision ball launch system which releases the ball with out a component of acceleration.

These and additional objects, advantages, features and benefits of the present invention will become apparent from the following specification.

DETAILED DESCRIPTION OF THE PREFERRED EMBODIMENTS

Figure 1:
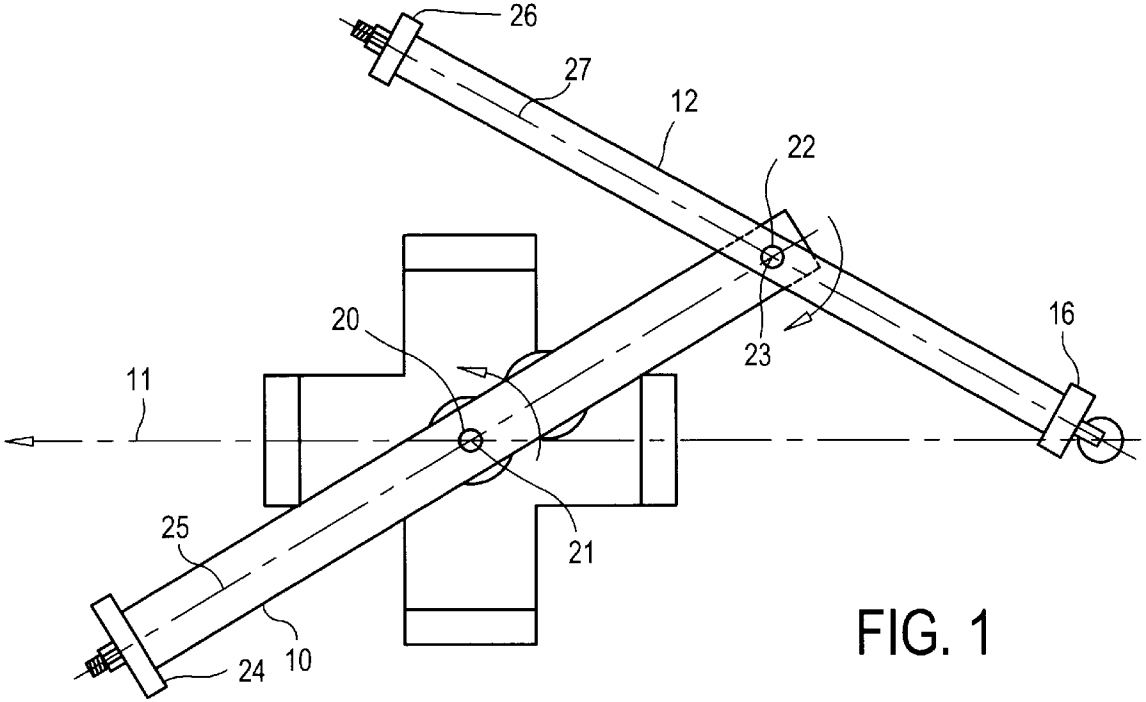
FIG. 1 is a top view of a high precision ball launch system in accordance with the present invention.
Figure 1A:
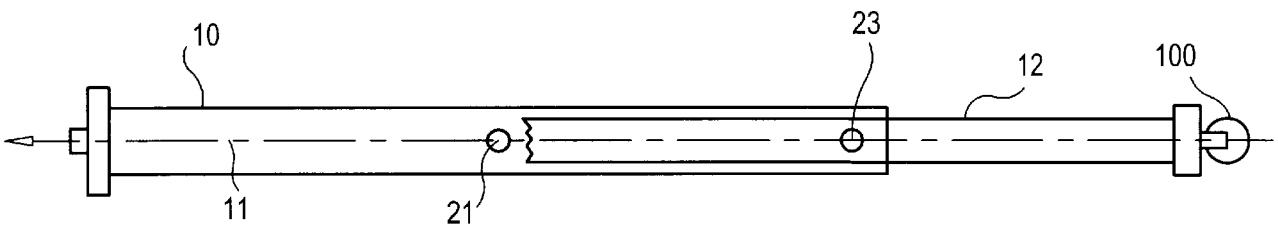
FIG. 1*a* is a top view of a major and minor link of a high precision ball launch system aligned to grasp a ball in accordance with the present invention.
Figure 2:
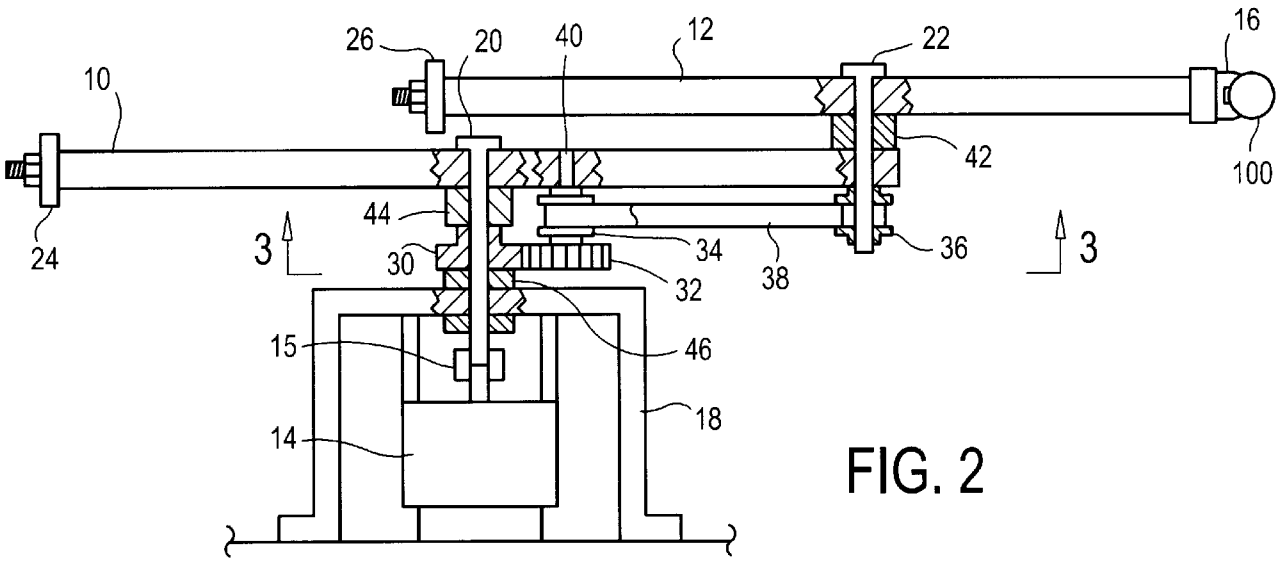
FIG. 2 is a revolved side view of a high precision ball launch system in accordance with the present invention.

With reference now to the drawings, and particularly to FIG. 1, there is shown a top view of a high precision ball launch system 1. With reference to FIG. 2, the high precision ball launch 1 includes a major link 10, minor link 12, drive device 14, ball release mechanism 16, and support base 18. The major link 10 is pivotally attached to the support base 18 at a major axis 21 and preferably rotated about a major axis pin 20 by the drive device 14. Preferably, a minor axis 23 of the minor link 12 is pivotally attached to one end of the major link 10. The other end of the major link 10 is preferably counter balanced with at least one weight 24 to compensate for the weight of the minor link 12.

The ball release mechanism 16 is attached to one end of the minor link 12. The other end of the minor link 12 is preferably counter balanced with at least one weight 26 to compensate for the weight of the ball release mechanism 16. The ball release mechanism 16 is preferably positioned on the minor link 10 such that a center of the ball 100 passes through the major axis 21 during its linear travel. If the center of the ball passes through the major axis, the ball 100 will have a straight line of trajectory and substantially zero acceleration when released. If the center of the ball 100 does not pass through the major axis 21, the ball 100 will not have substantially zero acceleration when released. The major link 10 is rotated in one direction and the minor link is rotated in the opposite direction.

Figure 3:
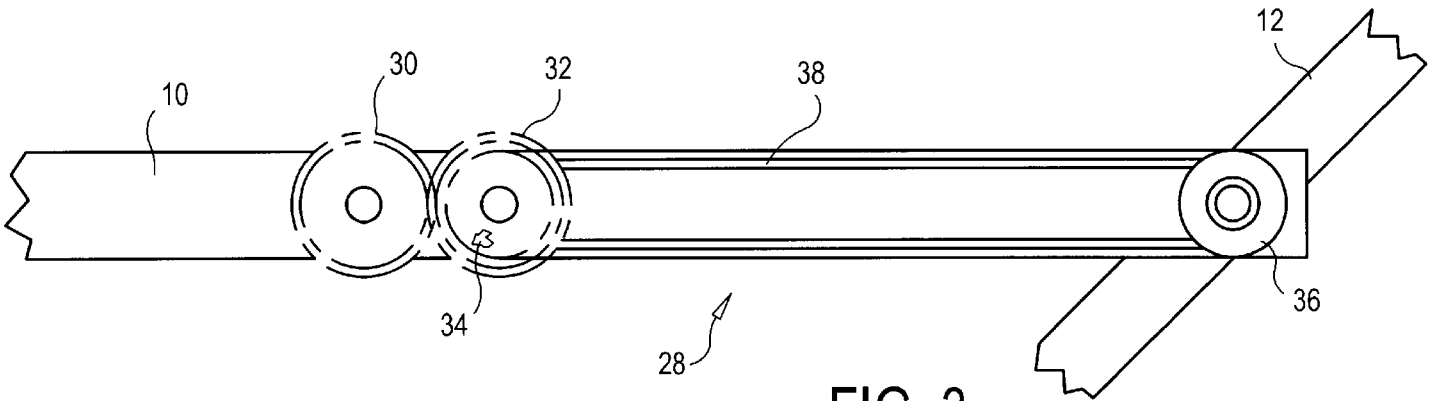
FIG. 3 is an enlarged bottom view of a minor link drive system of a high precision ball launch system in accordance with the present invention.

FIG. 3 shows an enlarged bottom view of a preferred minor link drive system 28. The minor link drive system 28 includes a drive spur gear 30, driven spur gear 32, drive pulley 34, driven pulley 36, and a belt 38. Although a gear and belt drive combination is shown, other suitable drive systems may also be used. The major axis pin 20 is rigidly attached to the major link 10 and driven by the drive device 14 through a shaft coupler 15. The drive device 14 could be an electric motor, or any other suitable drive mechanism.

The drive spur gear 30 is rigidly attached to the major axis pin 20. The drive spur gear 30 drives the driven spur gear 32 in an opposite direction. The drive pulley 34 and the driven spur gear 32 are rigidly attached to a rotary pin 40. The rotary pin 40 rotates relative to the major link 10. The drive pulley 32 drives the driven pulley 36 through the drive belt 38. The driven pulley 36 is rigidly attached to the minor axis pin 22; the minor axis pin 22 is rigidly attached to the minor link 12; and the minor axis pin 22 rotates relative to the major link 10. A link rotary spacer 42 is preferably placed between the major and minor links to reduce friction and provide a clearance therebetween. A major rotary spacer 44 is preferably placed between the major link 10 and the drive spur gear 30 to reduce friction and provide clearance therebetween. A base rotary spacer 46 is preferably placed between the major link 10 and the support base 18 to reduce friction. The rotary spacers could be roller bearings, solid bearings or any other suitable device or combination. Other spacer/bearing schemes may also be used.

Figure 4:
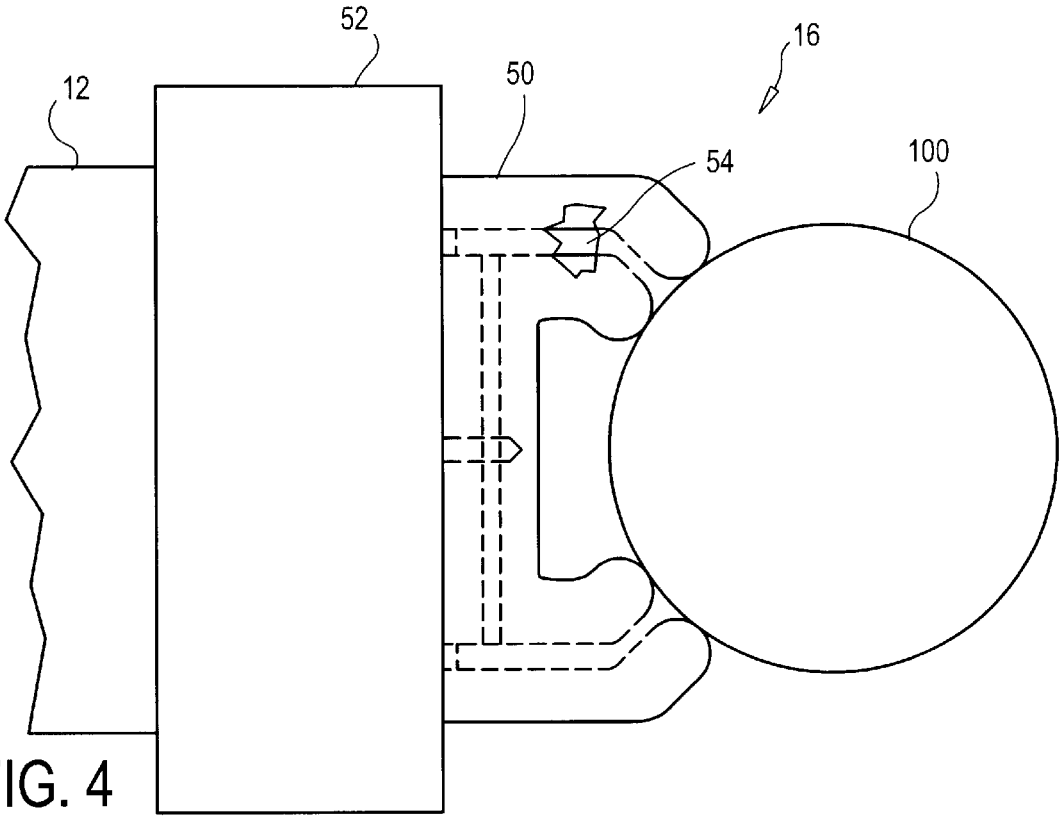
FIG. 4 is a side view of a vacuum ball gripper of a high precision ball launch system in accordance with the present invention.
Figure 5:
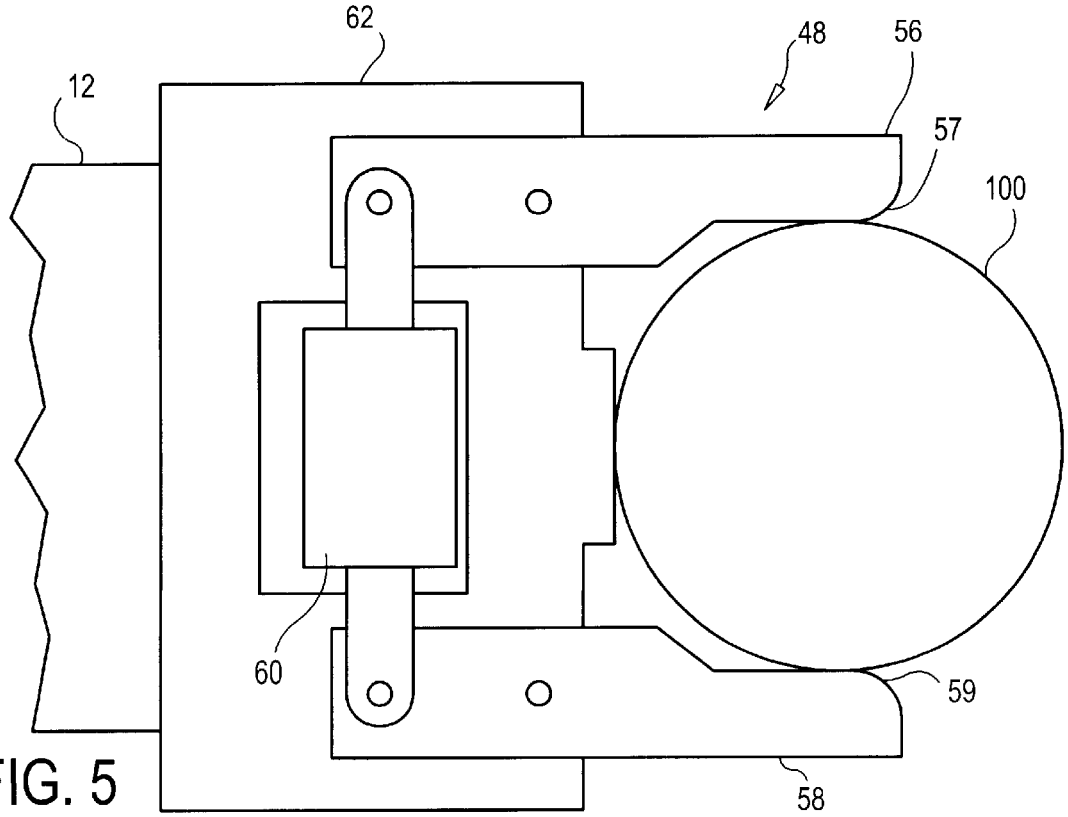
FIG. 5 is a side view of a mechanical ball gripper of a high precision ball launch system in accordance with the present invention.

The ball release mechanism 16 retains the ball 100 utilizing vacuum as shown in FIG. 4; a ball release mechanism 48 retains the ball 100 utilizing a gripper mechanism as shown in FIG. 5; or a ball release mechanism may retain the ball 100 utilizing any other suitable mechanism. The ball release mechanism 16 includes a vacuum cradle 50 and a vacuum generation device 52. The vacuum cradle 50 includes at least one vacuum passage 54 to retain the ball 100 in the vacuum cradle 50. The vacuum generation device 52 could be a vacuum pump or any other suitable device. The vacuum generation device 52 could be supplied with electrical power through slip rings disposed between the support base 14 and the major link 10, and between the major link 10 and the minor link 12. The electrical power could be supplied with electrical line current or through a battery. The battery could be attached to the end opposite the ball release mechanism 16 to act as a counter weight. The vacuum generation device 52 may be instructed to release the ball 100 through the use of a control signal imposed on the power line, an additional logic line, or through wireless control.

The ball release mechanism 48 includes a first gripper finger 56, second gripper finger 58, an actuation device 60, and a base 62. A first raised portion 57 is formed on a front of the first gripper finger 56 to retain the ball 100 and a second raised portion 59 is formed on a front of the second gripper finger 58 to retain the ball 100. The base 62 is attached to one end of the minor link 12. The first and second gripper fingers are pivotally attached to the base 62. Preferably, one end of an actuation device 60 is attached to a rear end of the first gripper finger 56 and the other end of the actuation device 60 is attached to a rear end of the second gripper finger 58. The actuation device 60 is preferably a solenoid, but other suitable devices may also be used. An example of another suitable device could be spring loaded gripper fingers made to release the ball 100 by striking an object at the time of release.

A separate actuation device could also be used to control the movement of each gripper finger to provide a curved line of trajectory by releasing one gripper finger early. The actuation device could be operated with electrical line current or with a battery. The actuation device 60 may be instructed to release the ball 100 through the use of a control signal imposed on the power line, an additional logic line, or through wireless control.

Figure 1C:
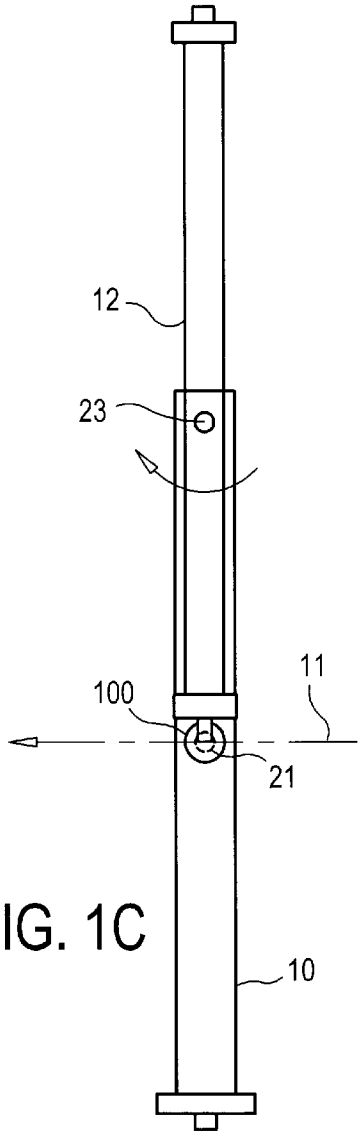
FIG. 1*c* is a top view of a major and minor link of a high precision ball launch system aligned to release a ball in accordance with the present invention.
Figure 1B:
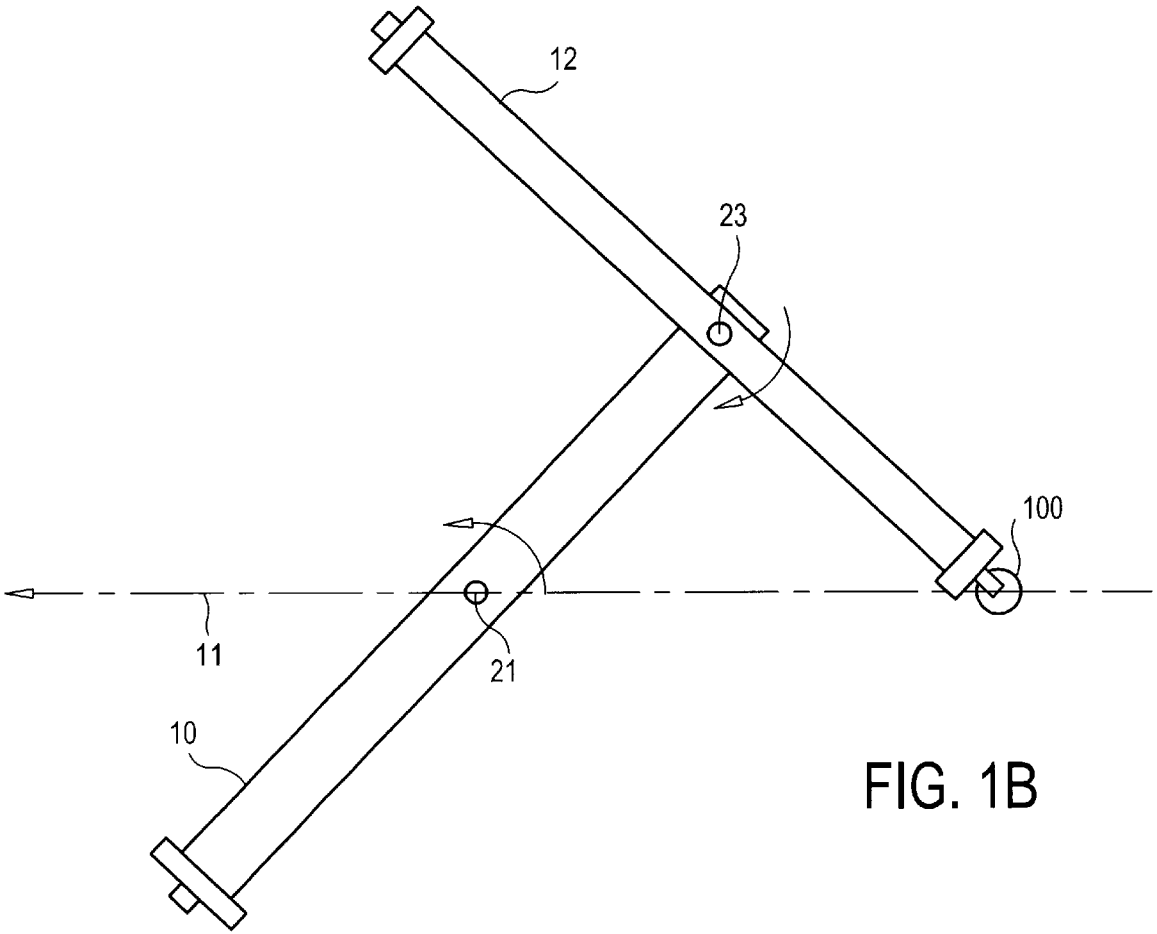
FIG. 1*b* is a top view of a major and minor link of a high precision ball launch system rotated 45 degrees from that shown in FIG. 1*a* in accordance with the present invention.
Figure 1D:
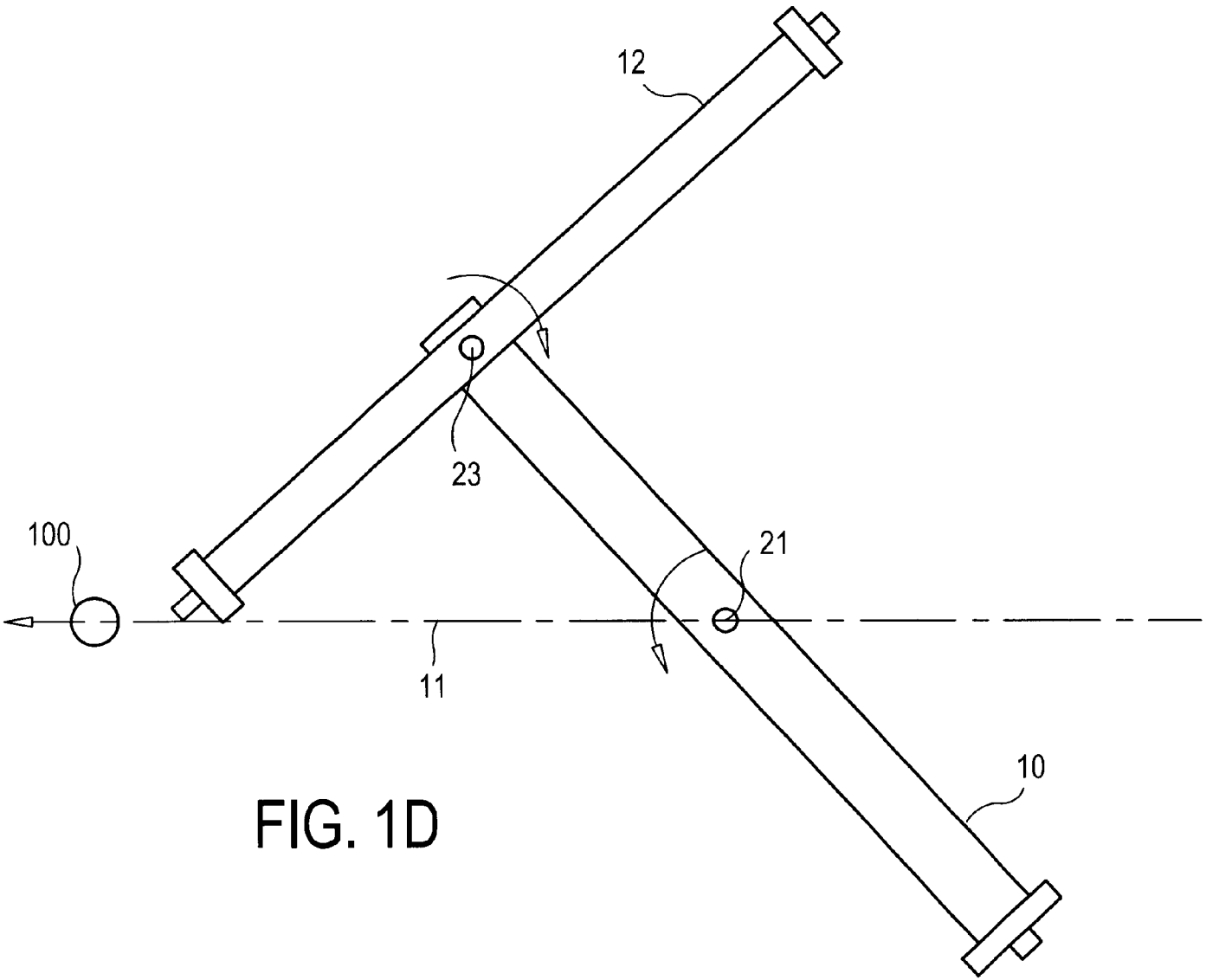
FIG. 1*d* is a top view of a major and minor link of a high precision ball launch system rotated 45 degrees from that shown in FIG. 1*c* in accordance with the present invention.

Assuming counter clockwise rotation for the major link 10 and clockwise rotation for the minor link 12 with a top view; substantially zero velocity exists when the center of the ball 100, a major longitudinal axis 25 of the major link 10, and a minor longitudinal axis 27 of the minor link 12 are aligned on the axis of trajectory 11 and the ball 100 at a right of the major axis 21 as shown in figure la. Assuming counter clockwise rotation for the major link 10 and clockwise rotation for the minor link 12 with a top view; substantially the highest velocity exists when the center of the ball 100 is aligned above the major axis 21 and the major longitudinal axis 25 and the minor longitudinal axis 27 are perpendicular to the axis of trajectory 11 as shown in FIG. 1*c*.

The ball 100 is preferably released when the high precision ball launch system achieves the highest velocity and the ball is preferably grasped when the high precision ball launch system 1 achieves substantially zero velocity. The ball 100 travels along the axis of trajectory 11 when released. The acceleration is substantially zero at the instant of release so the grasp force can be smoothly diminished and the release gentle. Spin could be imparted to the ball 100 along an axis orthogonal to the line of release by providing a spinning ball release mechanism located between the one end of the minor link 12 and the vacuum generation device 52, or between the one end of the minor link 12 and the ball release mechanism 48.

Figure 6:
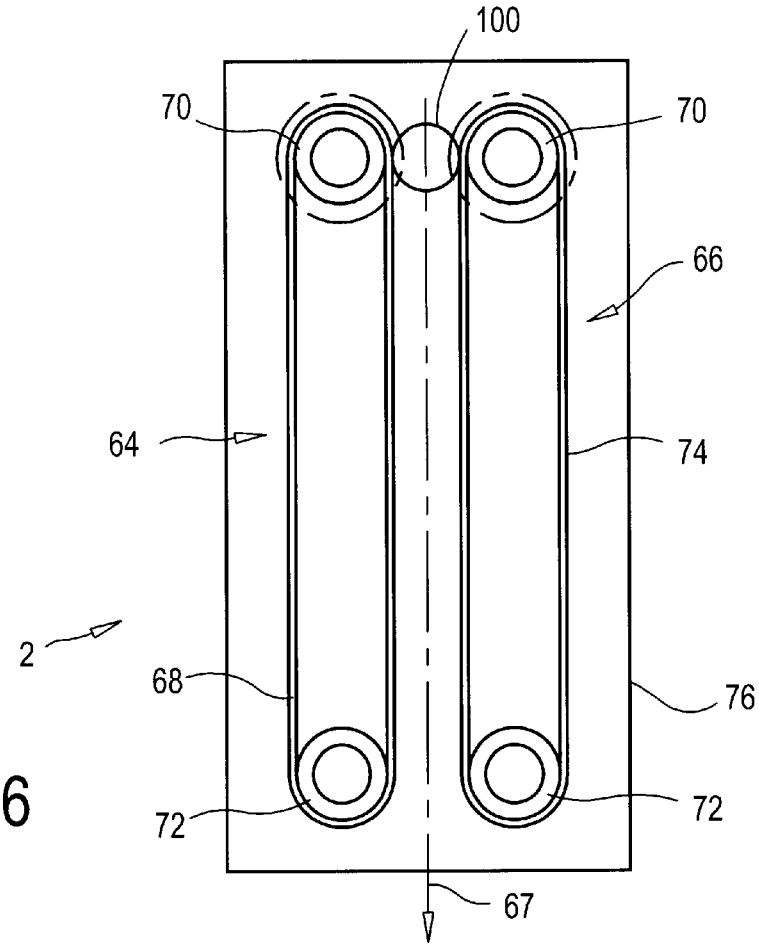
FIG. 6 is a top view of a second embodiment of a high precision ball launch system in accordance with the present invention.
Figure 7:
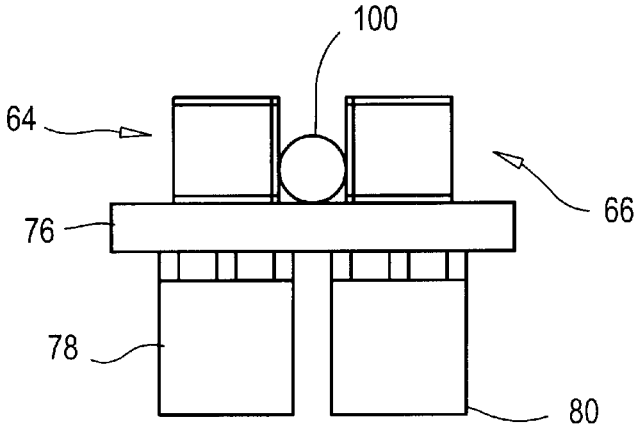
FIG. 7 is a front view of a second embodiment of a high precision ball launch system in accordance with the present invention.

With reference to FIGS. 6 and 7, a second embodiment of the high precision ball launch system 2 includes a pair of linear translating drive surfaces, at least one drive device, and a carriage 76. A first linear translating drive surface 64 and a second linear translating drive surface 66 are mounted to the carriage 76 such that the ball 100 may be propelled therethrough. Preferably, a separate drive device is used for each linear translating drive surface. A first drive device 78 is mounted to a bottom of the carriage 76 and translates the first linear translating drive surface 64. A second drive device 80 is mounted to a bottom of the carriage 76 and translates the second linear translating drive surface 66.

The first linear translating drive surface 64 includes a first linear drive surface 68, a drive wheel 70, and an idler wheel 72. A second linear translating drive surface 66 includes a second linear drive surface 74, the drive wheel 70, and the idler wheel 72. Each linear drive surface could be a belt, sprocket driven chain, or any other suitable device. The drive wheel 70 is disposed in one end of either linear drive surfaces and the idler wheel 72 is disposed in the other end of the linear drive surfaces. Each drive wheel 70 translates one of the linear drive surfaces. One drive wheel must rotate in a clockwise rotation and the other drive wheel must rotate in a counter clockwise rotation. The drive device could be an electric motor, or any other suitable drive mechanism.

Figure 8:
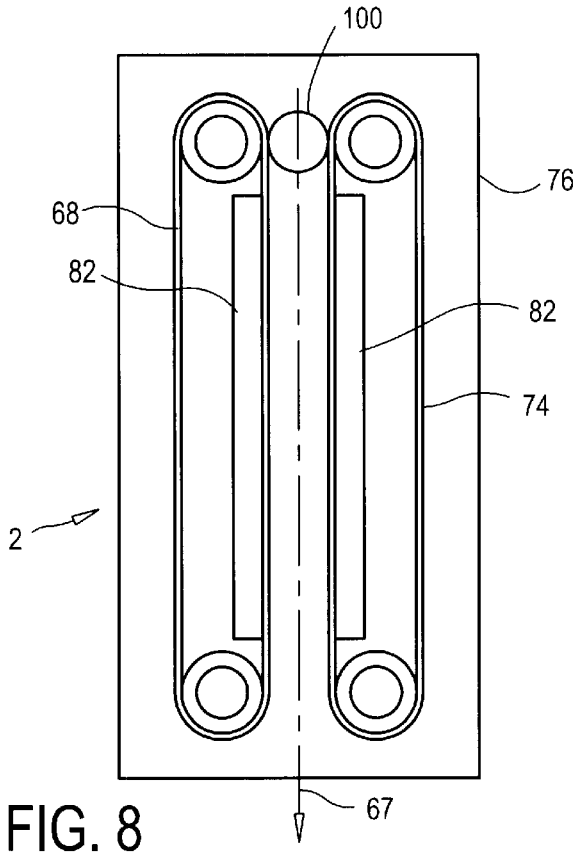
FIG. 8 is a top view of a second embodiment of a high precision ball launch system with a guide plate supporting each continuous drive surface in accordance with the present invention.
Figure 9:
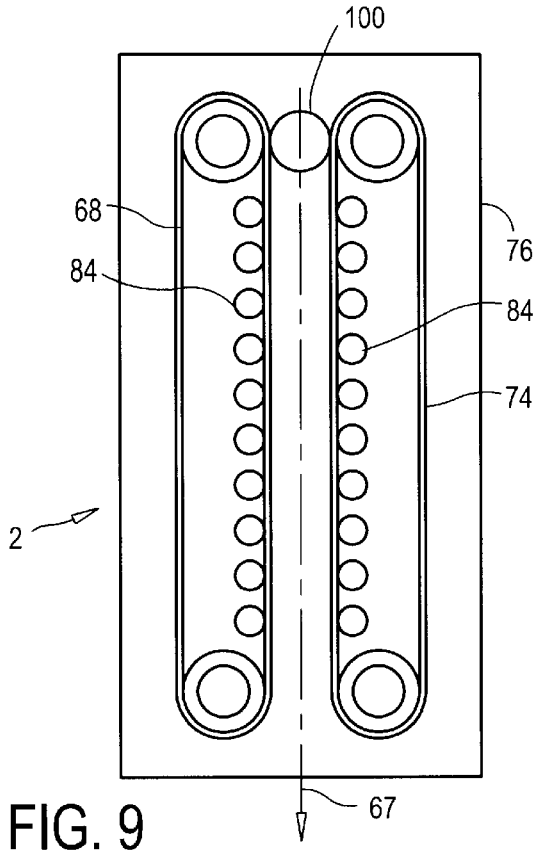
FIG. 9 is a top view of a second embodiment of a high precision ball launch system with a plurality of guide wheels supporting each continuous drive surface in accordance with the present invention.

Preferably, the distance between the drive and idler wheels is long enough to eliminate the effects of acceleration, jerk, and vibration. With reference to FIGS. 8 and 9, the distance between the first and second linear drive surfaces at the exit is preferably slightly greater than at the entrance to provide a gentle release of the ball. A single guide plate 82 may be attached behind each linear drive surface to provide the slightly greater distance at the exit than at the entrance. The surface of the guide plate 82 which contacts the linear drive surface preferably has a lower coefficient of friction. A set of wheels 84 may be substituted for a single guide plate 82. A curvature could be imparted to the line of trajectory by translating each linear drive surface at a different speed.

Figure 10:
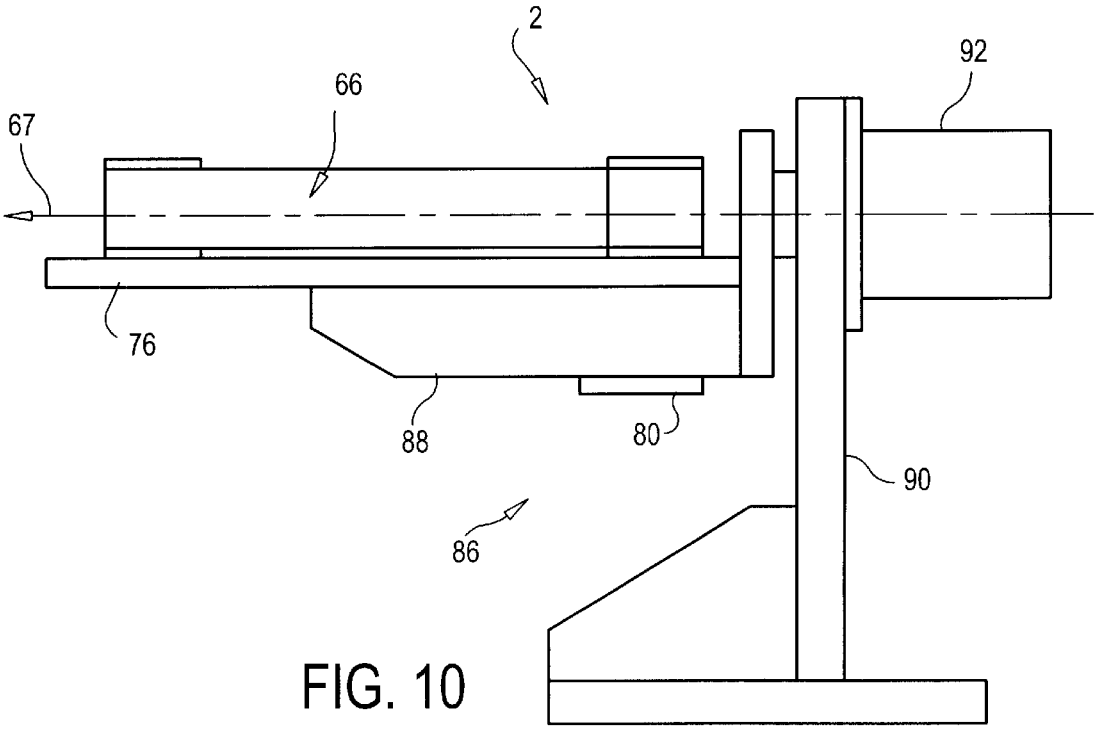
FIG. 10 is a side view of a second embodiment of a high precision ball launch system mounted to a rotary fixture in accordance with the present invention.

FIG. 10 shows a high precision ball launch system 2 which is attached to a rotation fixture 86. The rotation fixture 86 includes a cradle 88, a base 90, and a drive device 92. The carriage 76 is mounted to the cradle 88. The cradle 88 is pivotally attached to the base 90. The drive device 92 rotates the cradle 88 about the axis of trajectory 67 if it is desired to impart spin to the ball 100.

All drive devices and ball release mechanisms are controlled using any suitable electrical or electronic control circuitry including microprocessor based systems.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A method of launching a ball with high precision, comprising the steps of:

rotating a first link;

providing a second link that is pivotally attached to one end of said first link;

rotating said second link in a direction opposite of said first link;

providing a ball release mechanism that retains a ball, attaching said ball release mechanism to one end of said second link; and releasing the ball from said ball release mechanism.

2. The method of launching a ball with high precision of claim 1, further comprising the step of:

releasing the ball from said ball release mechanism when the ball is substantially over the pivot point of said first link.

3. The method of launching a ball with high precision of claim 1, further comprising the step of:

providing a support base for rotatably retaining said first link.

4. The method of launching a ball with high precision of claim 1, further comprising the step of:

providing a first drive device for rotating said first link and a second drive device for rotating said second link in a direction opposite said first drive link.

5. The method of launching a ball with high precision of claim 1, further comprising the steps of:

providing at least one first counter weight for attachment to the other end of said first link to counter balance the weight of said second link; and providing at least one second counter weight for attachment to the other end of said second link to counterbalance the weight of said ball release mechanism.

6. The method of launching a ball with high precision of claim 1, further comprising the step of:

providing electrical power to said ball release mechanism with a battery.

7. The method of launching a ball with high precision of claim 1, further comprising the step of:

providing electrical power to said ball release mechanism with slip rings and electrical line power.

8. The method of launching a ball with high precision of claim 1, further comprising the step of:

providing said ball release mechanism, said ball release mechanism including a vacuum cradle and a vacuum generation device, said vacuum cradle having at least one vacuum opening to retain said ball, said vacuum generation device generating a vacuum for at least one vacuum opening.

9. The method of launching a ball with high precision of claim 1, further comprising the step of:

providing said ball release mechanism, said ball release mechanism including a first gripper finger, a second gripper finger, at least one actuation device, and a base, said first and second gripper fingers being pivotally attached to said base such that a ball may be retained, said at least one actuation device controlling the movement of said first and second gripper fingers to retain said ball.

10. The method of launching a ball with high precision of claim 1 further comprising the step of:

providing a first electric motor for said first drive device and a second electric motor for said second drive device.

11. A method of launching a ball with high precision, comprising the steps of:

rotating a first link;

providing a second link that is pivotally attached to one end of said first link;

rotating said second link in a direction opposite of said first link;

providing a ball release mechanism that retains a ball, attaching said ball release mechanism to one end of said second link; and releasing the ball from said ball release mechanism when the ball is substantially over the pivot point of said first link.

12. The method of launching a ball with high precision of claim 11, further comprising the step of:

providing a support base for rotatably retaining said first link.

13. The method of launching a ball with high precision of claim 11, further comprising the step of:

providing a first drive device for rotating said first link and a second drive device for rotating said second link in a direction opposite said first drive link.

14. The method of launching a ball with high precision of claim 11, further comprising the steps of:

providing at least one first counter weight for attachment to the other end of said first link to counter balance the weight of said second link; and providing at least one second counter weight for attachment to the other end of said second link to counterbalance the weight of said ball release mechanism.

15. The method of launching a ball with high precision of claim 11, further comprising the step of:

providing electrical power to said ball release mechanism with a battery.

16. The method of launching a ball with high precision of claim 11, further comprising the step of:

providing electrical power to said ball release mechanism with slip rings and electrical line power.

17. The method of launching a ball with high precision of claim 11, further comprising the step of:

providing said ball release mechanism, said ball release mechanism including a vacuum cradle and a vacuum generation device, said vacuum cradle having at least one vacuum opening to retain said ball, said vacuum generation device generating a vacuum for at least one vacuum opening.

18. The method of launching a ball with high precision of claim 11, further comprising the step of:

providing said ball release mechanism, said ball release mechanism including a first gripper finger, a second gripper finger, at least one actuation device, and a base, said first and second gripper fingers being pivotally attached to said base such that a ball may be retained, said at least one actuation device controlling the movement of said first and second gripper fingers to retain said ball.

19. The method of launching a ball with high precision of claim 11, further comprising the step of:

providing a first electric motor for said first drive device and a second electric motor for said second drive device.

* * * * *